US008402572B2

(12) United States Patent
Herasimtschuk

(10) Patent No.: US 8,402,572 B2
(45) Date of Patent: Mar. 26, 2013

(54) TOILET ARMREST SUPPORT SYSTEM

(76) Inventor: Michael Herasimtschuk, Poughkeepsie, NY (US)

( * ) Notice: Subject to any disclaimer, the term of this patent is extended or adjusted under 35 U.S.C. 154(b) by 703 days.

(21) Appl. No.: 12/459,921

(22) Filed: Jul. 9, 2009

(65) Prior Publication Data

US 2011/0004989 A1 Jan. 13, 2011

(51) Int. Cl.
*E03D 11/00* (2006.01)

(52) U.S. Cl. ..... 4/254; 4/667; 4/480; 4/483; 4/578.1; 4/560.1

(58) Field of Classification Search ..... 4/254, 667, 4/480, 483, 578.1, 661, 560.1; 297/411.2, 297/DIG. 10
See application file for complete search history.

(56) References Cited

U.S. PATENT DOCUMENTS 2,774,975 A * 12/1956 Frank ..... 4/254
3,405,411 A * 10/1968 Brown ..... 4/254
5,592,703 A * 1/1997 Jones et al. ..... 4/667
6,161,229 A 12/2000 Ryan et al.
6,353,941 B1 3/2002 Manning et al.
6,421,842 B1 * 7/2002 Fujita ..... 4/236
6,857,138 B2 2/2005 Moser et al.
6,904,622 B1 6/2005 Gabriel
7,146,655 B2 * 12/2006 Karnopp et al. ..... 4/254
7,240,377 B2 * 7/2007 Vanden Heuvel ..... 4/237
7,987,529 B1 * 8/2011 Wise ..... 4/254

* cited by examiner

*Primary Examiner* — Gregory Huson
*Assistant Examiner* — Lauren Heitzer
(74) *Attorney, Agent, or Firm* — Oktay Enterprises Int'l., LLC; Sevgin Oktay

(57) ABSTRACT

Toilet armrest support system comprises a removable armrest platform having a centrally disposed opening that conforms to the opening over an existing toilet bowl rim. The removable armrest platform supports detachable armrests configured to provide a wider area under the armrests for larger individuals requiring more space. The relatively thin and rigid platform slides underneath an existing toilet seat and engages a docking sub-system fastened to existing hinge openings with toilet seat fasteners on the rear of the toilet. The docking sub-system is of unitary construction comprising docking bar, docking ports at each end of the docking bar, and an anchor block between the docking ports. The removable platform easily slides into the docking ports and under the elevated anchor block. A locking mechanism on the anchor block locks the removable platform securely in place which can then be removed just as easily and quickly.

20 Claims, 9 Drawing Sheets

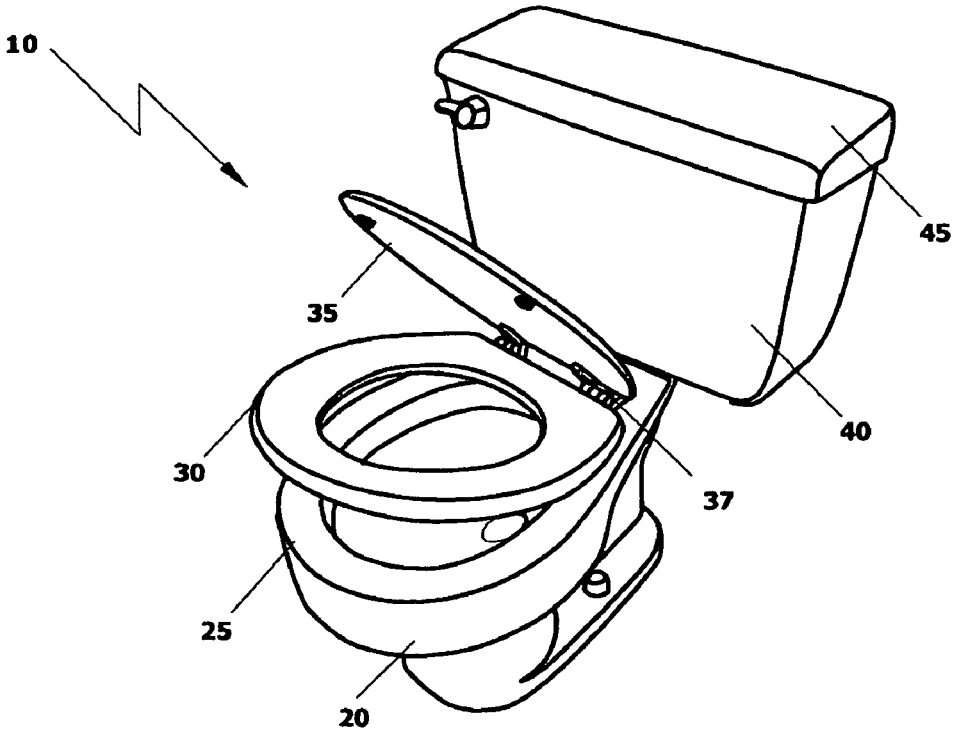
FIG. 1 -Prior Art
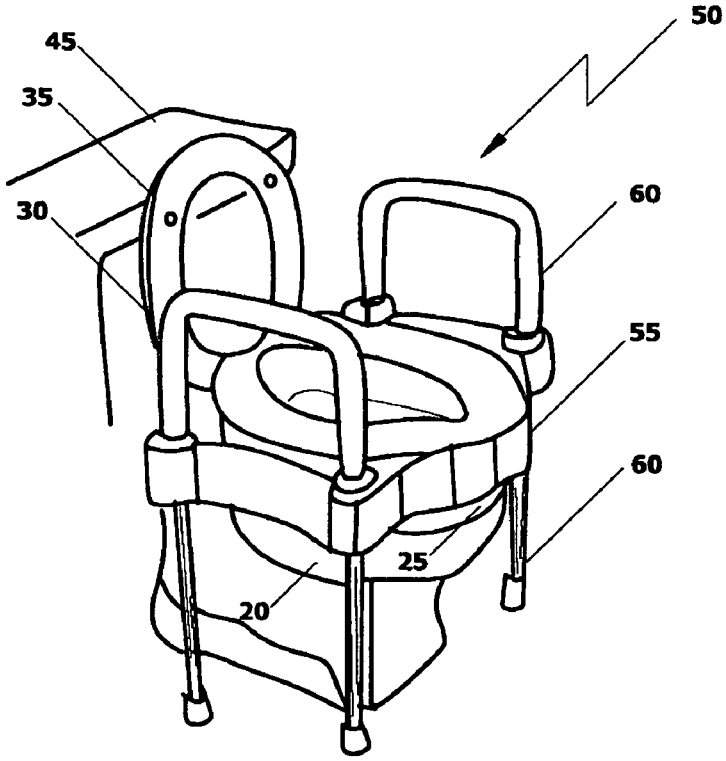
FIG. 2 -Prior Art

OEI-08.MH-118(NP)

OEI-08.MH-118(NP)

TOILET ARMREST SUPPORT SYSTEM

BACKGROUND

All references cited in this specification, and their references, are incorporated by reference herein where appropriate for teachings of additional or alternative details, features, and/or technical background.

Disclosed is a toilet armrest support system comprising an unobtrusive or stealthy docking sub-system having receptacles or ports configured to receive a removable platform with detachable armrests that can be quickly mounted on and off any standard toilet. The apparatus can be used as a toilet assist device or as an enhancement for toilet comfort.

A conventional toilet system 10, such as shown in FIG. 1, does not normally come with armrests. FIG. 1 shows a toilet bowl 20, toilet rim 25 of the bowl 20, toilet seat 30 and the seat cover 35. Both the toilet seat 30 and the seat cover 35 are configured to open and close with a pair of common hinges 37, which are secured to the back of the toilet rim 25 with bolts and wing-nuts (not shown). A water tank 40 is also usually secured to the rear of the toilet system 10 by means of bolts that are accessible inside the tank after the lid 45 is removed. As these general features of a conventional toilet system are well-known in the art, they are not described in detail here in order not to unnecessarily obscure the present disclosure.

Toilet assemblies with armrests are known for primarily medical uses. For example, for handicapped people who have difficulties in getting on and off toilets, there are raised toilet seats. Some come equipped with arm rests, such as shown in FIG. 2. The toilet assembly 50 shown in FIG. 2 is usually an independent structure with raised seat 55, armrests 60 and legs 70 which can be placed on a conventional toilet system 10 shown in FIG. 1. As shown in FIG. 2, the raised seat 55 is placed over (or clears) the rim 25 of the toilet bowl 20 of a conventional toilet system 10 while the toilet seat 30 and the seat cover 35 are held open against the water tank 45. The legs 60 and the armrests 60 may be adjusted to accommodate the ergonomic needs of the user of the toilet.

Still with other conventional toilet assists that are described in the references below, the armrests need to be attached to the existing toilet in quite a number of different ways, with quite a number of different tools and they all require quite an extensive assembly time. Usually, the people who most need assistance in toilet functions do not have the stamina or the ability to put together such complex apparatus. At the same time, from a sanitary point of view, it is difficult get around some of the structures, such as the seat area, the legs and the armrest, for that matter, to keep the toilet area clean. If one were to try to move or remove the assist portions and put them back together again, it would be quite difficult for the reasons given above.

What is needed therefore is an apparatus that can easily be mounted and dismounted on a toilet rim with no additional fasteners other than provided with standard toilets while keeping the existing toilet seat and seat cover and at the same time providing ergonomically comfortable armrests to assist in performing bodily functions.

REFERENCES

Leon M. Ryan, et al., of U.S. Pat. No. 6,161,229 disclose an apparatus having a frame, front and rear guides rigidly secured to the frame and having front and rear channels passing there-through, angling rearwardly from top to bottom. A toilet seat is operably connected to the frame and is movable between a lowered position and a raised position. A driver is operably connected to the toilet seat to move the seat between the lowered and raised positions. An armrest is provided, the armrest having front and rear members slidably passing through the front and rear channels of the front and rear guides, respectively. The front and rear armrest members are operably connected to the driver for moving them through the front and rear channels as the armrest moves between a lowered position and a raised position. The armrest may be operably connected to the driver so that a top portion of the armrest remains in a substantially horizontal position as the armrest moves between the lowered position and the raised position. The armrest may also be operably connected to the driver by a linkage having a first member rigidly secured to lower portions of the front and rear armrest members, a second member pivotally secured to the first member and operably connected to the toilet seat for pivotal motion relative to the toilet seat, and a third member pivotally secured to the first member and operably connected to the driver for pivotal motion relative to the driver.

Katharine C. Manning of U.S. Pat. No. 6,353,941 provides a light weight portable toilet seat designed to be used on top of a standard, commercial adult toilet seat and to provide a safe, stable, ergonomic seating area. The seat is slim, small and light enough to be carried by a child of toilet-training age. It has also been fitted and may be used on many types of adult toilet seats, including those used in airplanes and boats, for true portability. The seat is molded from a single piece of plastic and has a formed bottom surface which is free of ribs and edges that could catch dirt. The lack of hinges or folds in the seat precludes pinching of the child's skin and reduces potential structural weakness. The absence of cleats or clips makes installation easy for either child or adult. The lack of ribs and edges on the bottom makes the seat more sanitary than existing seats. The seat fits over the front portion of the adult seat rather than being centered over the bowl and, thus, is a more ergonomic seating position for a child.

Scott Andrew Moser of U.S. Pat. No. 6,857,138 describes an ergonomic raised toilet seat assembly, comprising an ergonomically contoured raised toilet seat, ergonomically shaped armrests, ergonomically shaped secondary grips, ergonomically shaped grip handles, and a quick release system for rapid installation and removal from a toilet.

Andrew E. Gabriel of U.S. Pat. No. 6,904,622 teaches an auxiliary toilet seat including a seat portion that is positionable on top of a toilet stool rim. Such a seat portion has an integrally disposed flange extending rearwardly from the opening. The apparatus includes a back portion pivotally connected to the flange that has a front surface including a plurality of resilient support members extending forwardly therefrom and a horizontally disposed support plate extending rearwardly therefrom. A rigid fastening member including opposed end portions is positioned through the support plate for effectively securing the toilet seat to the toilet stool. A plurality of arm rests are connected to the back portion wherein such arm rests are movable along a plurality of arcuate paths and a linear path. The arm rests include a plurality of elongated support portions and a plurality of couplings operably connected to the support portions.

SUMMARY

Aspects disclosed herein include an apparatus comprising a toilet armrest support system disposed over an existing toilet bowl having centrally disposed opening with a rim, the armrest support system further comprising at least one or more armrests supported by a removable platform disposed underneath an existing toilet seat and engaged to a docking sub-system which in turn is fastened to existing hinge openings with toilet seat fasteners on the rear of a standard toilet system; the docking sub-system having at least two or more docking ports to receive slideably a slotted edge of the removable platform and an anchor block having an elevated portion forming a cavity located centrally in between the docking ports; the anchor block configured to receive the slotted edge of the removable platform slideably in the cavity and to lock/unlock the armrest platform in situ with the turn of a latching mechanism by hand; and the removable platform is formed to fit over the toilet rim and provide a wider sitting area towards a front portion of the toilet seat than towards the rear to readily accommodate the entry of differing body sizes onto the toilet seat with armrest support.

an apparatus comprising a toilet armrest support system, the armrest support system further comprising at least one or more armrests supported by a removable armrest platform disposed underneath an existing toilet seat and slideably engaged to an anchor block of a docking sub-system, which in turn is fastened to existing hinge openings with toilet seat fasteners on the rear of a standard toilet system; the docking sub-system comprises a docking bar having at least a first end and a second end, each end having a docking pier and corresponding to each docking pier, a docking port; the docking port comprising a pair of docking plates configured spatially apart with to form a receptacle to receive slideably the slotted edge of the removable armrest platform; and at least one anchor block disposed between the docking pier at each end, the docking ports being configured to receive slideably slotted edge of the removable armrest platform, the anchor block being elevated to slideably receive below it the slotted edge of the armrest platform to secure/release the removable platform from the existing toilet.

an apparatus comprising a toilet armrest support system further comprising a removable armrest platform dockable to a docking sub-system, the removable armrest platform having one or more removable armrests; the docking sub-system of unitary construction further comprising a docking bar having at least a first end and a second end, each end having a docking pier and corresponding to each docking pier, a docking port; the docking port comprising at least two or more docking plates configured spatially apart to receive slideably one or more slots provided on the armrest platform; at least one anchor block disposed substantially centrally in between the docking piers; the anchor block elevated to slideably receive underneath and lock in place the removable armrest platform substantially centrally with a latching mechanism provided in the anchor block; the latching mechanism capable of locking and unlocking the removable armrest platform in situ with the turn of a latching mechanism by hand; and thus provide a toilet armrest platform that can be ergonomically slid in an out from the docking sub-system for ease of comfort and sanitary care; and armrests further having different profiles to fit the needs of people with different body sizes, wherein the armrests for larger profiles have higher legs where the rear legs attach to the back top surface of the removable platform while the font legs loop around to the front and attach to the underside of the platform; the armrests with smaller profile have their rear legs attach to the back top surface of the platform while the front legs loop around to the front; and still another profile having both the front and the rear legs with medium height attached to the underside of the removable armrest platform.

BRIEF DESCRIPTION OF DRAWINGS

FIG. 1 shows a conventional toilet system.

FIG. 2 shows a conventional toilet system modified to have a raised toilet seat with armrests.

DETAILED DESCRIPTION

In embodiments there is illustrated a toilet armrest support system. The toilet armrest support system comprises a removable armrest platform having a centrally disposed opening that conforms to the opening over an existing toilet bowl rim. The removable armrest platform supports detachable armrests configured to provide the maximum open area under the armrests for larger individuals requiring more space. The relatively thin and rigid platform slides underneath an existing toilet seat and engages a docking sub-system fastened to existing hinge openings with toilet seat fasteners on the rear of the toilet. The docking sub-system is of unitary construction comprising a docking bar, docking ports at each end of the docking bar, and an anchor block between the docking ports. The removable platform slides easily into the docking ports and under the elevated anchor block. A locking mechanism on the anchor block locks the removable platform securely in place. The toilet seat may then be lowered on to the now immovable platform which has already been fitted with attachable armrests. Armrests have a wider opening at the front than at the rear to accommodate easy entry and exit. The user may then lower himself/herself onto the toilet with the aid of the armrests with ample room for individuals with varying body sizes. Armrests with different profiles are provided. Armrests for larger profiles have higher legs where the rear legs attach to the back top surface of the removable platform while the font legs loop around to the front and attach to the underside of the platform. The armrests with smaller profile that are more suitable for children and young adults with smaller body sizes, have their rear legs attach to the back top surface of the platform while the front legs loop around to the front and unlike the larger armrests, they attach to the top surface of the removable platform. In another profile, both the rear and front legs of the armrests attach to the bottom of the removable armrest platform. After repeated use, the removable platform with the armrests can be easily and completely removed by releasing the platform from the anchor block by releasing the locking latch (or screw) and pulling the platform forward. Once the platform of the toilet armrest support system is removed, only the "stealthy" docking sub-system remains unobtrusively behind the toilet seat while continuing to safely support the toilet seat for an extended period of time or until the platform needs to be reinstalled.

Figure 3:
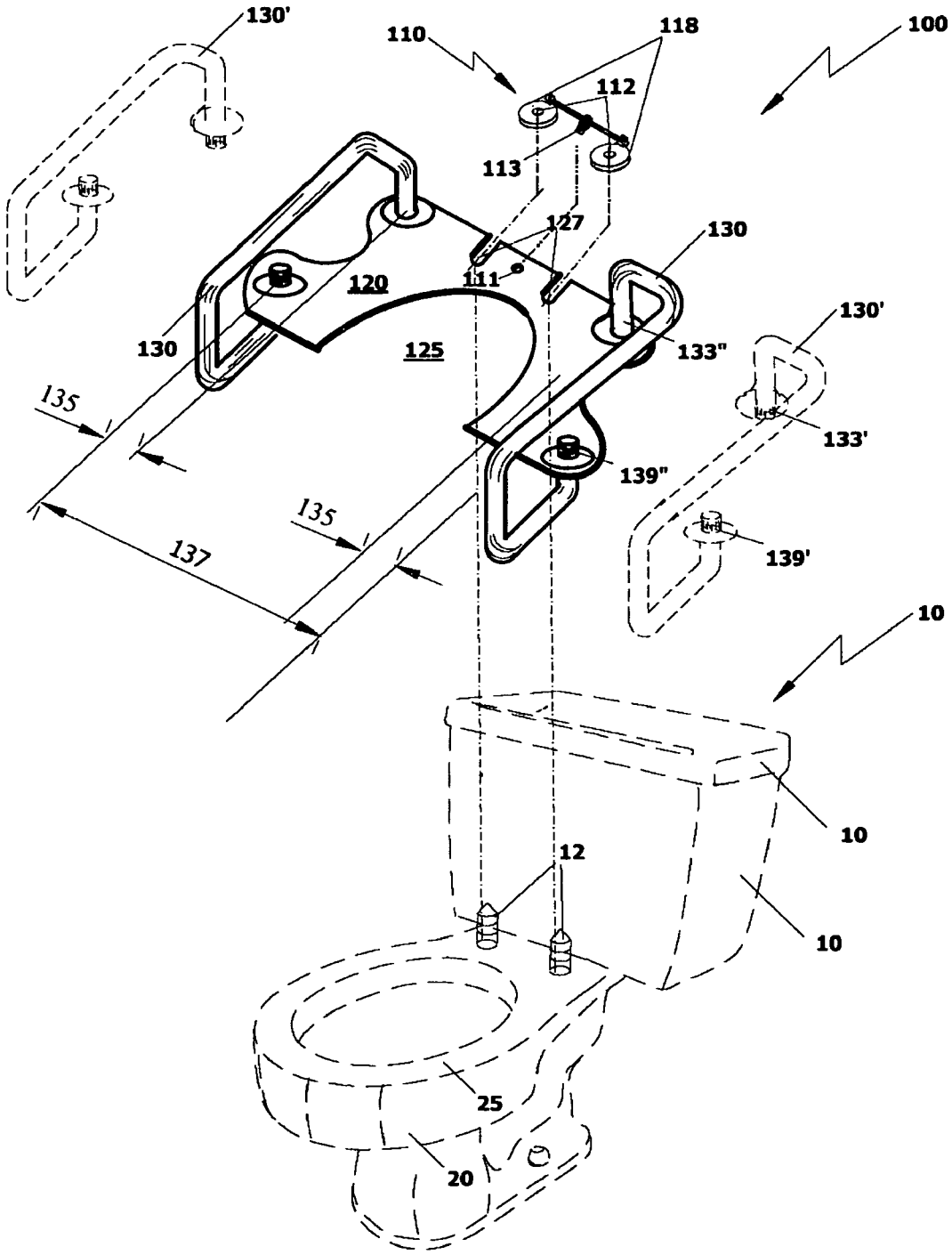
FIG. 3 shows an embodiment of a disclosed toilet platform with removably attachable armrests.

Referring now to drawings, the Toilet Armrest Support System 100 shown in FIG. 3 comprises a docking sub-system 110 which can be installed unobtrusively behind a toilet seat 30 without compromising the integrity of any standard toilet system 10. As shown in FIG. 3, docking sub-system 110 having openings 112 is aligned over screws 12 of any standard toilet, and secured to toilet rim 25 by tightened screws 12. Docking sub-system 110 is capable of receiving a platform 120 inconspicuously disposed over the rim 25 and under toilet seat 30 of any standard toilet. Platform 120 supports detachable armrests 130, and is capable of being locked or anchored in place with an anchoring device 113. The platform, 120, including the attached armrests, 130, can easily be unlocked from the docking sub-system, 110, and slid to and fro docking ports 118 to seat and unseat, respectively, slots 127 in and out of the corresponding docking ports 118. In this manner, the platform, 120, along with the armrests, 130, can easily be removed and replaced for hygienic cleaning and other purposes. The system apparatus can be used as a toilet assist device or as an enhancement for toilet comfort.

FIG. 3 shows in particular, an exploded view of the disclosed toilet armrest support system 100 as would be installed on an existing standard toilet system 10 (shown in phantom) with hinged toilet seat 30 and toilet lid 35 of FIG. 1 removed. System 100 comprises, a docking sub-system 110 a platform 120 and armrests 130 supported by platform 120.

Armrests 130' shown in phantom in FIG. 3 may be assembled into position 130 (similar numerals refer to similar elements throughout the several views) on platform 120 either before or after having installed docking sub-system 110. Docking sub-system 110 is secured to the rear of the toilet rim 25 by utilizing the screws 12 found exposed on any standard toilet after having removed the toilet seat 30 and the toilet seat cover 35. (It will be noted that in some installations, screws 12 may be inserted in an orientation opposite to shown in the various Figures with the head of the screw in the "up" position).

It is usually easier and simpler to perform the assembly of the armrests 130' first. This is accomplished by inserting and securing the ends 133' and 139' of armrests 130' shown in phantom into predetermined locations 133" and 139", respectively, on the armrest platform, 120. It will be noted in FIG. 3 that locations 133" and 139" are off-set by an amount 135. It will be understood later in the specification that the wider opening 137 in the front provides ergonomic comfort for larger body sizes.

Figure 4:
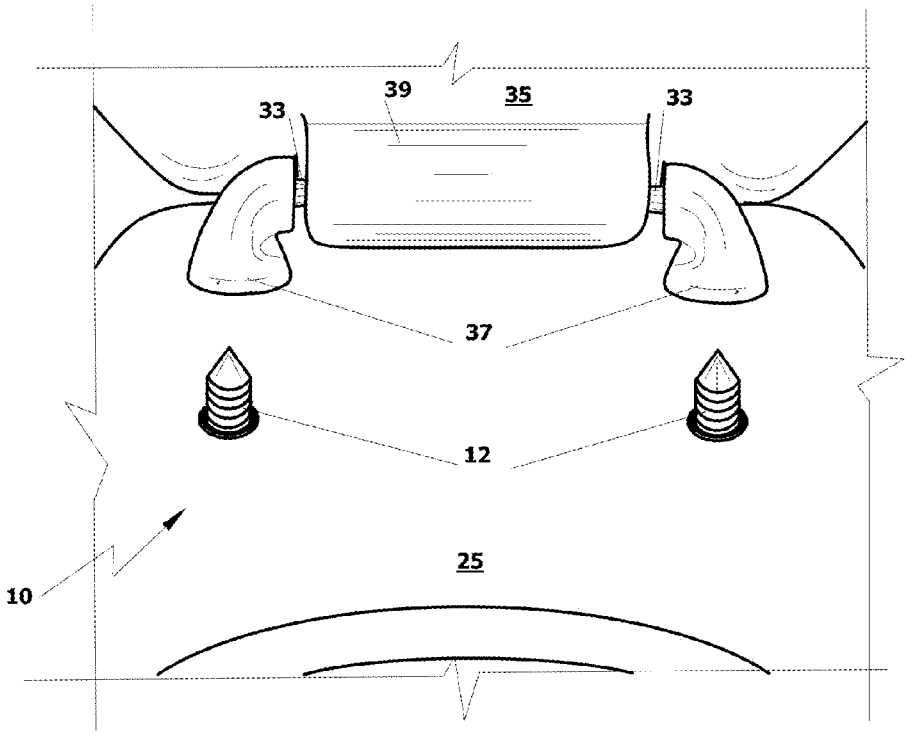
FIG. 4 shows an aspect of an embodiment of the disclosed removable armrest support platform disposed over existing hinge openings with toilet seat fasteners on the rear of a standard toilet system.

FIG. 4 shows another type of a standard toilet system with a different hub fixture 39 to secure the seat cover 35 to the toilet. The toilet seat (not shown) has been removed to show an overlying toilet seat cover 35 that can be secured to the toilet rim 25 by inserting the standard screws 12 into the threaded elements 37 on the underneath surface of the toilet seat cover 35 and then tightening the heads (not shown) of the screws at the rear underneath the toilet rim 25. Pins 33 affixed to elements 37 enter corresponding openings in hub 39 of toilet seat cover 35 to provide the required tilting of the toilet seat cover 35 up and down, as is common with standard toilet systems.

Figure 5:
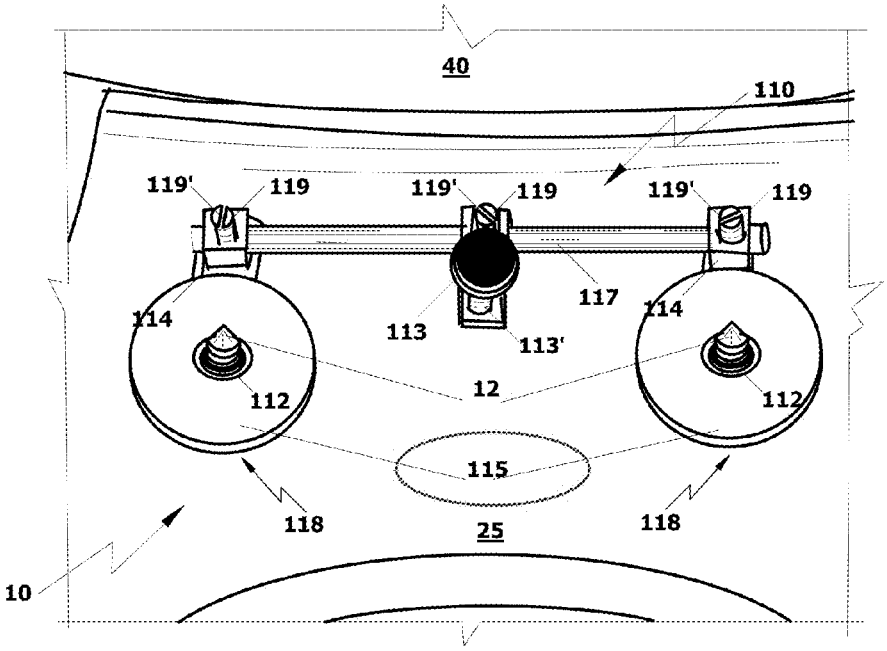
FIG. 5 shows an experimental prototype of the disclosed docking sub-system disposed over existing hinge openings with toilet seat fasteners on the rear of a standard toilet system.

FIG. 5 shows a prototype of an experimental docking subsystem 110 used in the development of the presently disclosed Toilet Armrest Support System 100. The docking system 110 shown in FIG. 5 comprises a bar 117 and slideably adjustable clamps 119. The clamping onto bar 117 is accomplished by tightening screws 119'. The center clamp is configured to have a locking mechanism 113 comprising a screw 113' which engages a corresponding threaded opening 111 in platform 120 shown in FIG. 6. The experimental clamps, 119, on the right and left of bar 117 as viewed by the reader, are fitted with arms 114 which support docking ports 118 having openings 112 configured to receive screws 12 as shown in FIG. 5.

Figure 6:
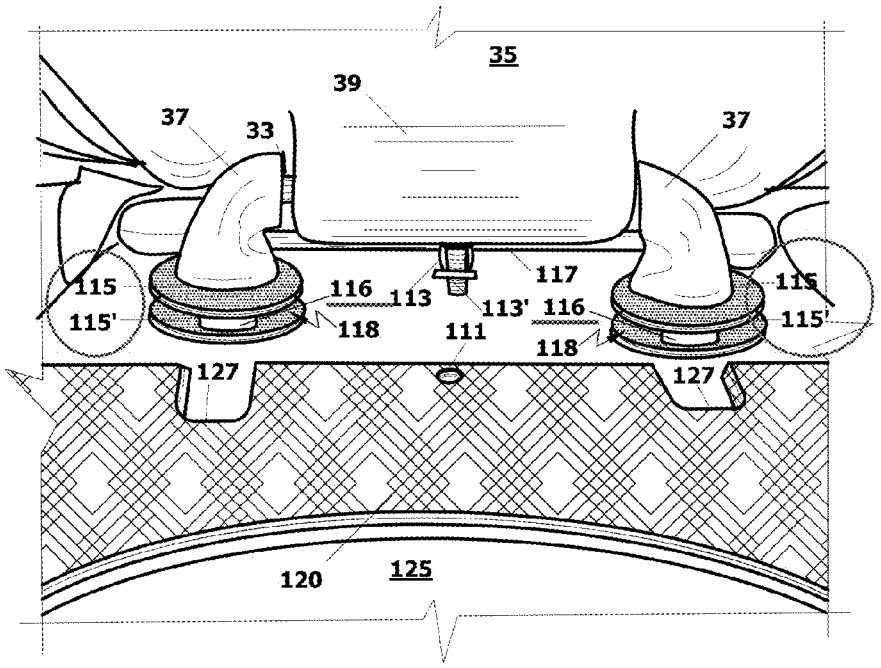
FIG. 6 shows an embodiment of the docking ports of the disclosed docking sub-system of FIG. 5.

FIG. 6 shows another view of docking ports 118 ready to receive slots 127 formed on platform 120. Docking ports 118 comprise of disks 115 and 115' with a space 116 in between of a thickness to accommodate the thickness of platform 120 as described further below. In installation, platform 120 is placed over the rim 25 of the toilet bowl 20 (hidden under platform 120 in FIG. 6. But seen in FIG. 3) and slid towards space 116 in between disks 115 and 115'. Once in place in space 116, threaded opening 111 of platform 120 is aligned with screw 113' of the locking mechanism 113 of the docking subsystem 110. The armrest platform 120 is then firmly secured to the docking subsystem 110 by tightening the screw 113'. Subsequently, toilet seat 30 may be lowered over platform 120, as shown in FIG. 7, and toilet 20 readied for use.

Figure 7:
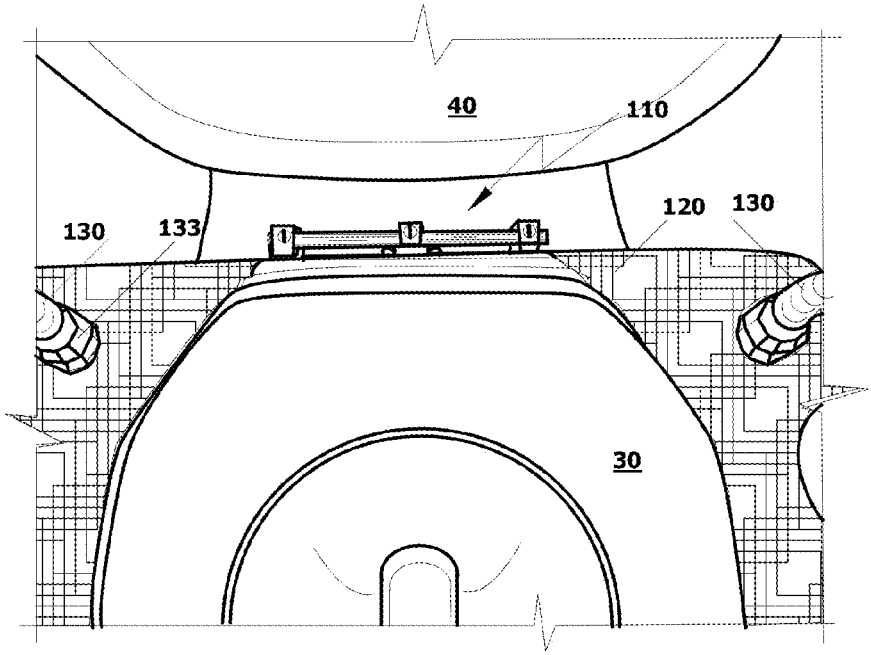
FIG. 7 shows the unobtrusive placement of the docking sub-system at the rear of a standard toilet system according to the present disclosure of the Toilet Armrest Support System.
Figure 8:
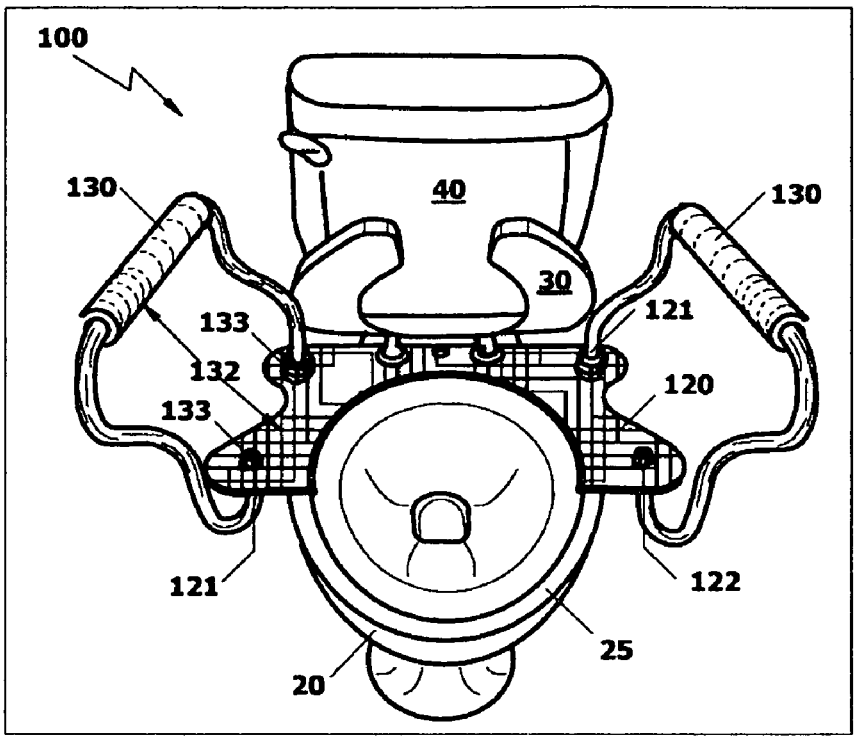
FIG. 8 shows an embodiment of the disclosed larger profile armrests where the rear legs of the armrests are attach to the back top surface of the removable platform while the font legs loop around to the front and attach to the underside of the platform, according to the present disclosure of the Toilet Armrest Support System.
Figure 9:
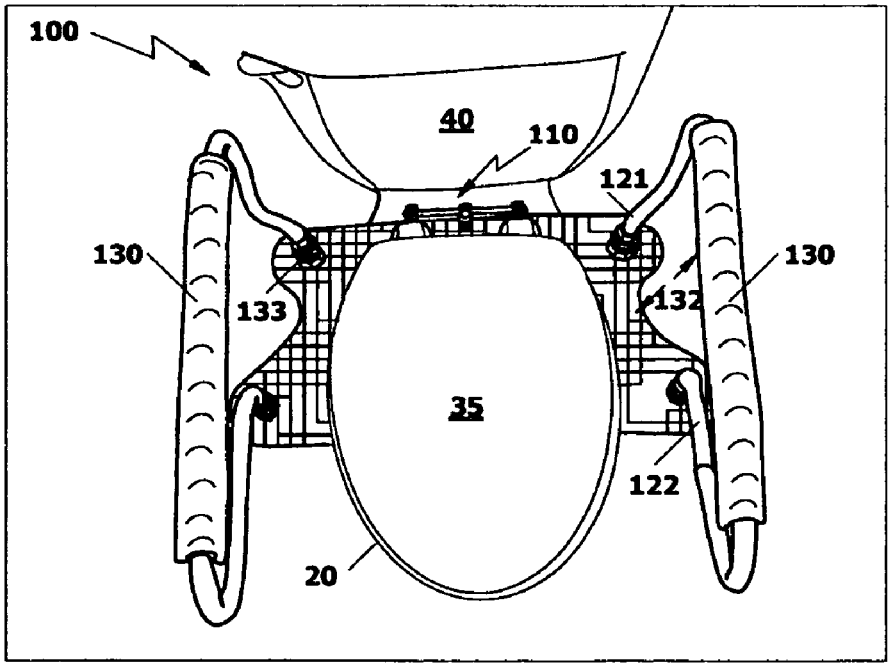
FIG. 9 shows an embodiment of the disclosed smaller profile armrests where both the rear and front legs of the armrests attach to the top surface of the platform, according to the present disclosure of the Toilet Armrest Support System.

It will be noted that the docking subsystem 110 remains inconspicuously clear of the way towards the rear of any standard toilet system, as shown in FIGS. 7, 8 and 9. Furthermore, any time armrest platform 120 needs to be removed, for cleaning, for example, what all needs to be done is to unscrew screw 113' from tapped hole 111 shown in FIG. 6 and slide back platform 120. Armrests 130 seen in FIGS. 7, 8 and 9 may also be used as an aid in sliding back the armrest platform 120. In this experimental prototype Toilet Armrest Support System 100, armrests 130 shown in 7, 8 and 9 comprise flexible tubing and are installed using conventional connectors 133 and tools which will not be described in detail here in order not to unnecessarily obscure the outline of the present disclosure. It will be noted in FIG. 8 that first ends 121 of armrests 130 are connected from the underside of platform 120 and second ends 122 from the topside of platform 120, while in FIG. 9 both the first ends 121 and the second ends 122 are connected from the topside of platform 120, as viewed in the same FIGS. 8 and 9. It will be evident to those skilled in the art that the armrests 130 may be installed in any combination of using either the topside or underside connections 133, including the installation from the underside only, as discussed later in relation to the personalized armrest(s) (not shown here) of special ergonomic comfort of a user as seen further in the example shown in FIG. 17.

Figure 10:
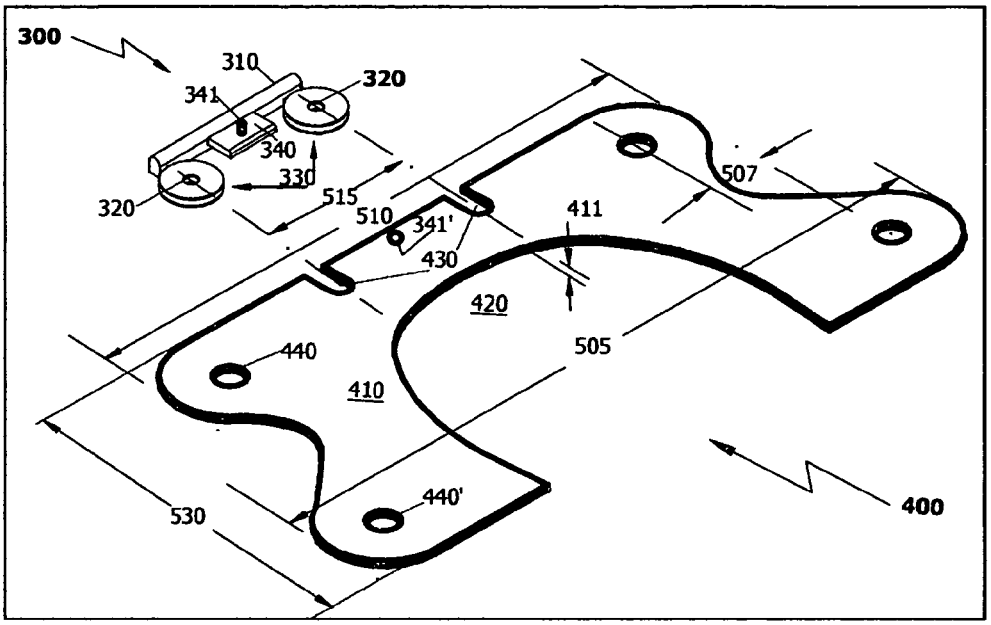
FIG. 10 shows a different prototype of a docking sub-system aligned with the removable armrest platform, according to the present disclosure of the Toilet Armrest Support System.
Figure 15A:
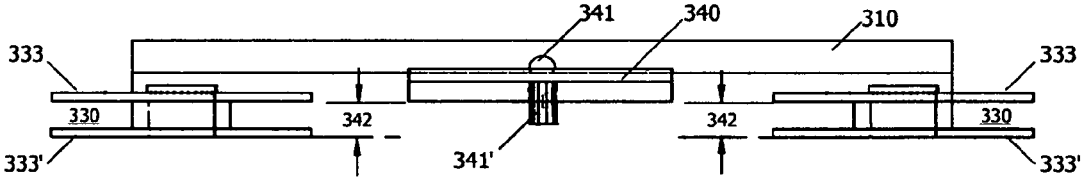
FIGS. 15*a* and *b* show enlarged views of FIGS. 14*c* and *b*, respectively, according to the present disclosure of the Toilet Armrest Support System.
Figure 15B:
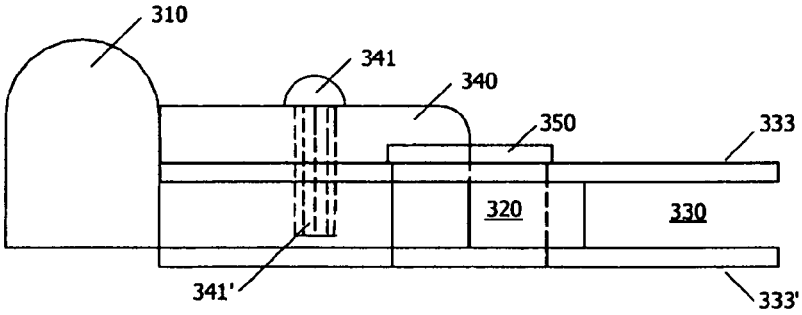
Figure 16:
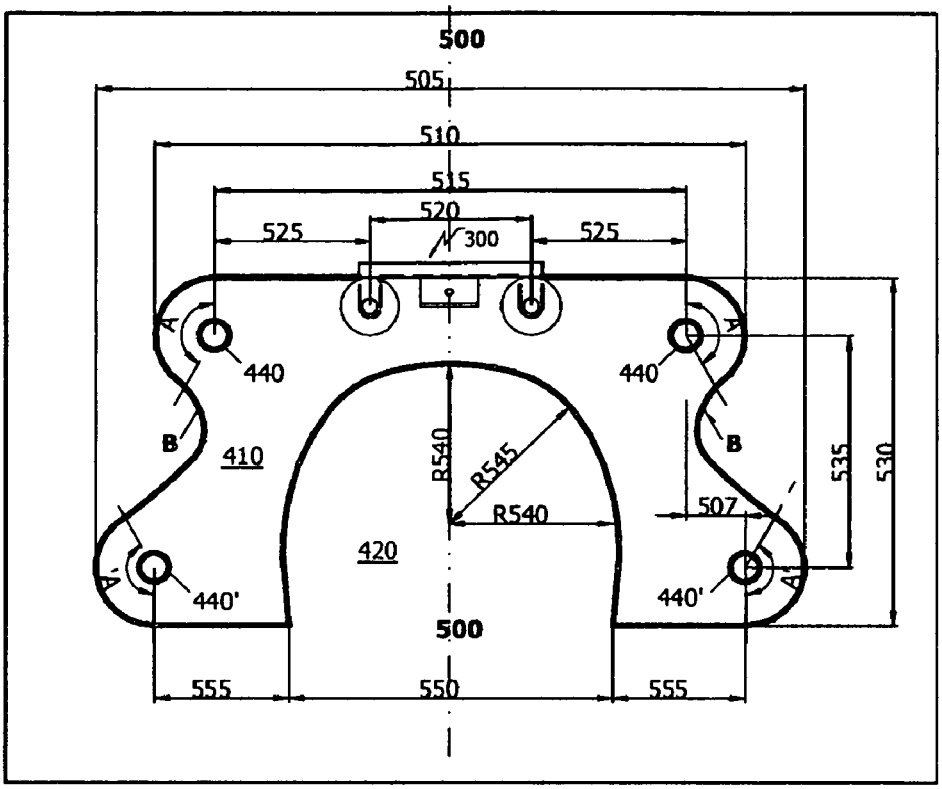
FIG. 16 shows the dimensions of the removable armrest platform, according to the present disclosure of the Toilet Armrest Support System.
Figure 17:
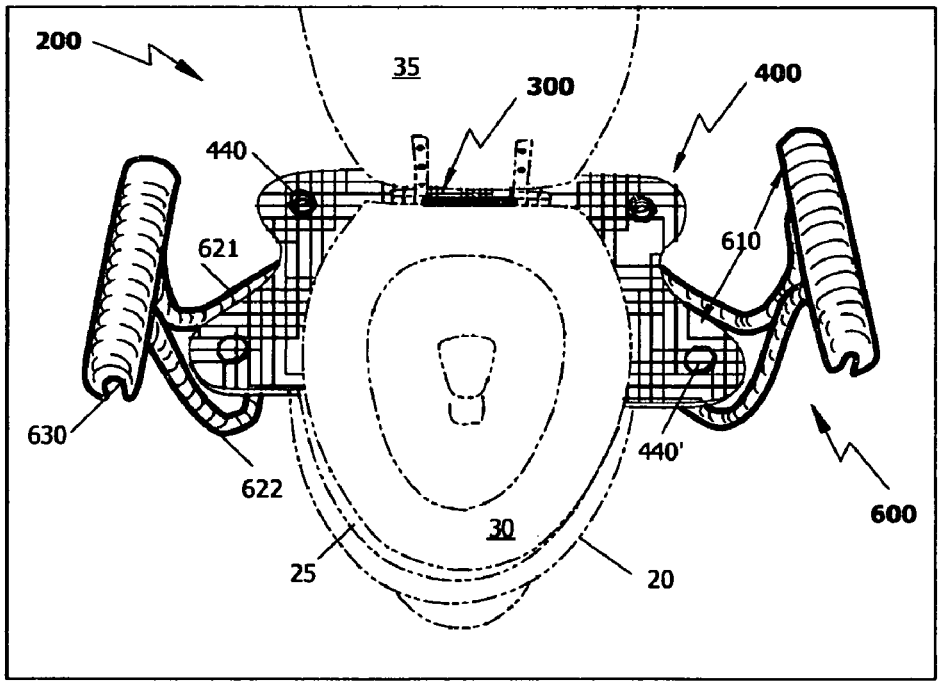
FIG. 17 shows an embodiment of different profile armrests where both the rear and front legs of the armrests are attached to the bottom surface of the removable armrest platform, according to the present disclosure of the Toilet Armrest Support System.

FIGS. 10-16 along with FIG. 17 show embodiments of a different prototype of the disclosed Toilet Armrest Support System 200 comprising an armrest 600, armrest support system 400 and a docking sub-system 300 which can be installed on any standard toilet system. Specifically, FIG. 10 shows how a disclosed armrest platform 410 engages a docking sub-system 300 in a manner similar to the experimental support system 100 described earlier in FIGS. 1-9. Armrest platform 410 is configured to rest on a toilet rim with an opening 420 which conforms to the opening of a standard toilet. Armrest 600 (shown in FIG. 17) attaches to openings 440 and 440'. Openings 440 and 440' are off-set from each other by an amount 507 as shown in FIG. 10 and also FIG. 16 in order to accommodate the configuration of the armrests which in turn determine the frontal and rear dimensions 505 and 510, respectively, of the armrest platform 410 as described below and better seen in FIG. 16.

Figure 11:
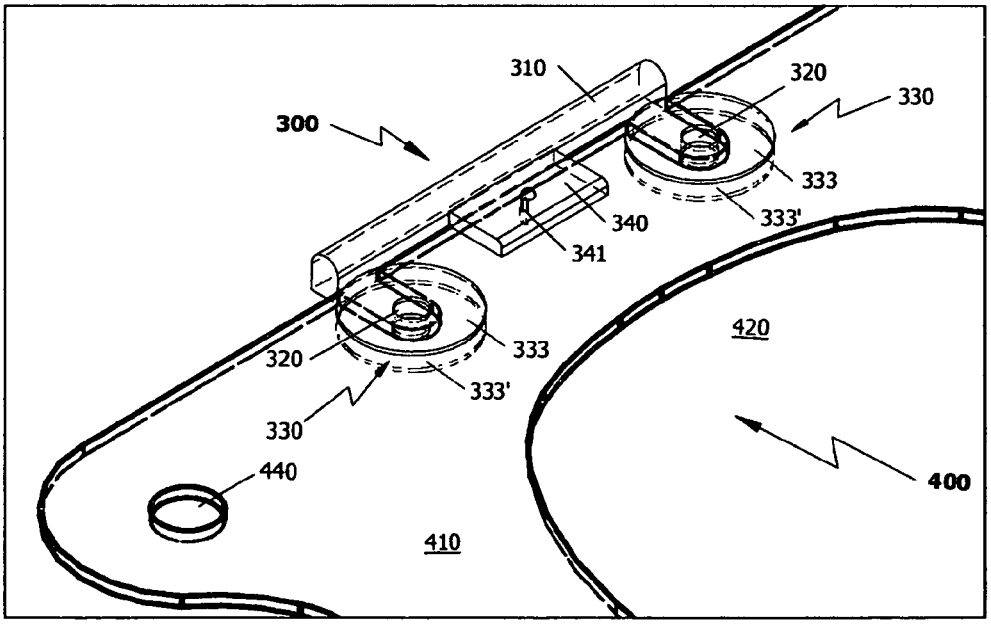
FIG. 11 shows the engagement of the docking sub-system of FIG. 10 above with the removable armrest platform, according to the present disclosure of the Toilet Armrest Support System.

Docking sub-system 300 comprises docking ports 330 which are secured to the rear of a toilet system by inserting the fasteners of any standard toilet system into to the openings 320 shown in FIG. 11 similar to the docking ports 118 of FIG. 6. Armrest platform 410 slides in between receptacle docking plates 333 and 333' configured spatially apart (see, for example, element 116 in FIG. 6) comprising docking ports 330 via slots 430 formed into removable armrest platform 410 as shown in FIG. 10. Slots 430 are aligned with docking ports 330 shown in FIG. 11.

FIG. 11 shows a close-up of the engagement of removable armrest platform 410 with docking ports 330 in between upper and lower docking plates 333 and 333', respectively, while sliding beneath anchor block 340. Docking plates 333 and 333' form a space to receive removable armrest platform 410 having a nominal thickness 411 of 3/16 inch ranging from 1/8 to 1/4 inch. As the removable armrest platform 410 slides into docking ports 330, it also slides into a cavity formed under the elevated anchor block 340 and is secured to the anchor block 340 by means of a locking mechanism 341 as seen in FIG. 11. Locking mechanism 341 engages an opening 341' in the armrest platform 410 as shown in FIG. 10.

Figure 12:
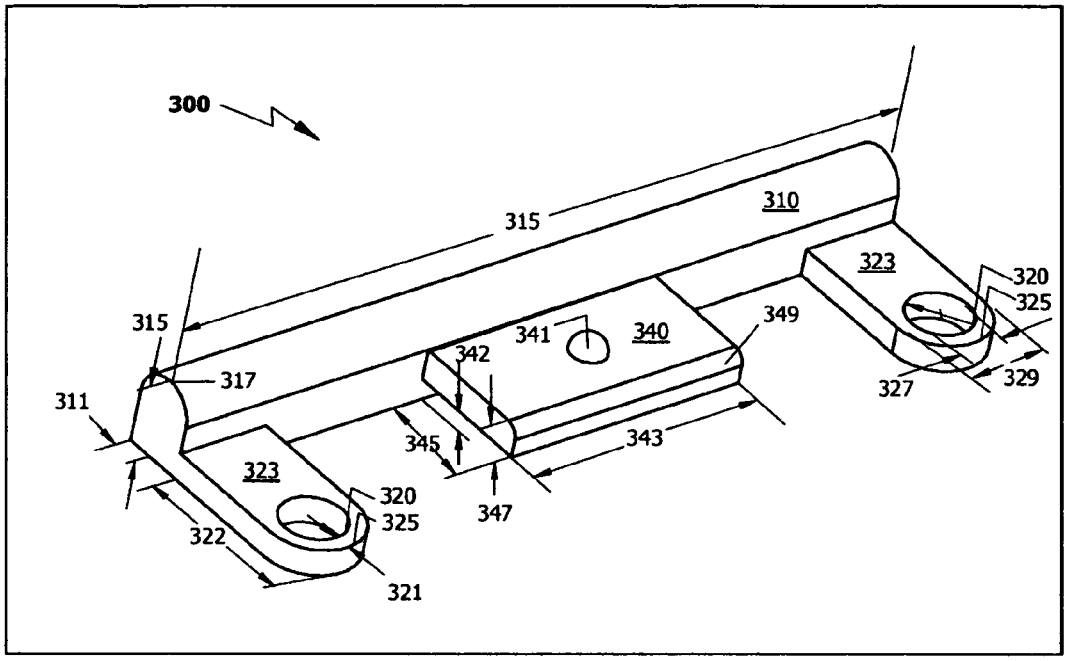
FIG. 12 shows the docking sub-system comprising a docking bar, docking piers and an anchor block, according to the present disclosure of the Toilet Armrest Support System.

More specifically, in an embodiment of the disclosed Toilet Armrest Support System, the docking sub-system 300 shown in FIG. 12 comprises a docking bar 310 having at least a first end and a second end, each end having a docking pier 323, and corresponding to each docking pier, a docking port 330, the docking ports being configured to receive slideably the slots 430 of platform 410 in between docking plates 333 and 333' and an anchoring block 340 enabled to lock and unlock platform 410 having detachable armrests (reference numeral 630 shown in FIG. 17) by means of a locking mechanism 341. In an aspect of the embodiment shown in FIG. 12, docking bar 310, docking piers 323 and anchor block 340 comprise one piece molded plastic although they can comprise any material suitable for use in a toilet environment, including metals. It is also understood that the parts can be made separately and joined to form the disclosed unitary docking sub-system.

Figure 13:
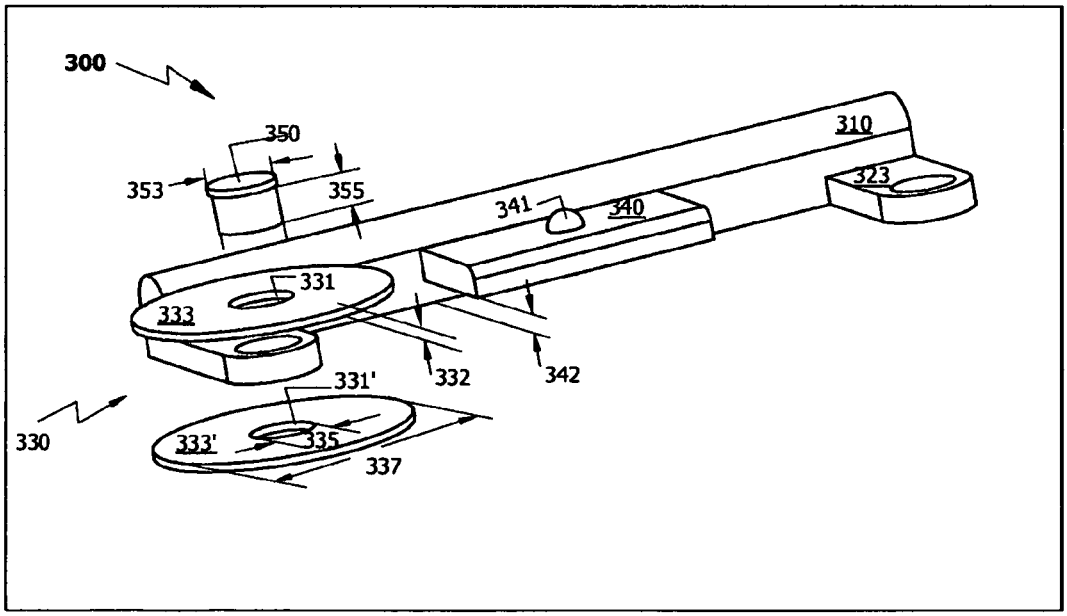
FIG. 13 shows a partially exploded view of the formation of a docking port with docking discs installed above and below the docking pier, according to the present disclosure of the Toilet Armrest Support System.

Docking bar 310 has a nominal length 315 of 6 1/4 inches ranging from about 6 inches to about 6 1/2 inches, nominal width 311 of 1/2" ranging from about 3/8 to about 5/8 inches, and nominal height 313 of 11/16" ranging from about 5/8 to about 3/4 inches. Docking piers 323 extend from docking bar 310 with a nominal length 322 of 1 3/8" ranging from about 1 1/4" to about 1 1/2", a nominal width 329 of 3/4" ranging from about 3/16 to about 5/16 inches and a nominal thickness 321 of 7/32" ranging from about 3/16 to about 1/4 inch. The free ends of docking piers 323 have a circular opening 320 of a nominal diameter of 1/2" diameter ranging from about 3/8 to about 5/8 inches at a distance of about 1 inch from the fixed end at the docking bar 310. These openings 320 are used to secure the docking sub-system 300 to a toilet system by inserting screws (such as shown in FIGS. 4 and 5) into openings 320 and covering them up by inserting caps 350 as shown in FIG. 13. In another aspect of an embodiment, FIG. 13 shows an exploded view of docking plates 333 and 333', disposed above and below, respectively, the docking piers 323 to form docking ports 330 (only one side of the docking ports is shown for clarity) with a space 330 configured to receive armrest platform 410. Docking plates 333 and 333' shown in FIG. 13 are of circular shape although plates of other shapes, including polygonal as well as contoured shapes may also be utilized. The docking discs 333 and 333' of docking ports 330 shown in FIG. 13 have a nominal diameter 337 of 2" ranging from about 1 7/8 to about 2 1/8 inches and a nominal thickness 332 of 1/16" ranging from about 3/64 to 5/64 inches. The disclosed prototype discs 333 and 333' shown in FIG. 1 comprise stainless steel washers though they may also comprise other materials suitable in a toilet environment, such as plastics. Discs 333 and 333' have openings 331 and 331' corresponding to openings 320 in docking piers 323. Cap 350 snaps into opening 331 in the upper disc 333 and force fit into opening 331' to capture and lock in disc 333' over the toilet screw that secures the docking sub-system 300 onto any standard toilet system, such as shown earlier in FIGS. 4 and 5. Cap 350 comprises a compression type fastener made out of materials suitable in a toilet environment, including plastics, and has a diameter 353 ranging from about 1/2 to about 5/8 inch with a neck of a length 355 ranging from about 10/32 to about 11/32 inches.

In an aspect of an embodiment, anchor block 340 shown in between docking piers 323 in both FIGS. 12 and 13 is formed at a nominal height 342 of 1/4" ranging from about 8/32 to about 9/32 inches above the surface a standard toilet rim (not shown). Height 342 is equivalent to the space provided in docking ports 330 in between upper and lower docking discs 333 and 333', respectively, and the thickness of one of the discs, to receive the removable armrest platform 410 via slots 430 as was described earlier in relation to FIG. 10. Anchor block 340 has a nominal length 343 of 2 inches ranging from about 1 3/4 to about 2 1/4 inches, a nominal width 345 of 1 inch ranging from about 7/8 to about 1 1/8 inches, and a nominal thickness 347 of 1/4" ranging from about 3/16 to about 5/16 inches. It will be noted that both the anchor block 340 and the docking bar 310 have rounded edges 349 and 317, respectively, though it will be understood that they need not be formed of the same. Furthermore, anchor block 340 may span the whole space between docking piers 323, and may be of other shapes of geometries and materials that are suitable in a toilet environment.

Figure 14A:
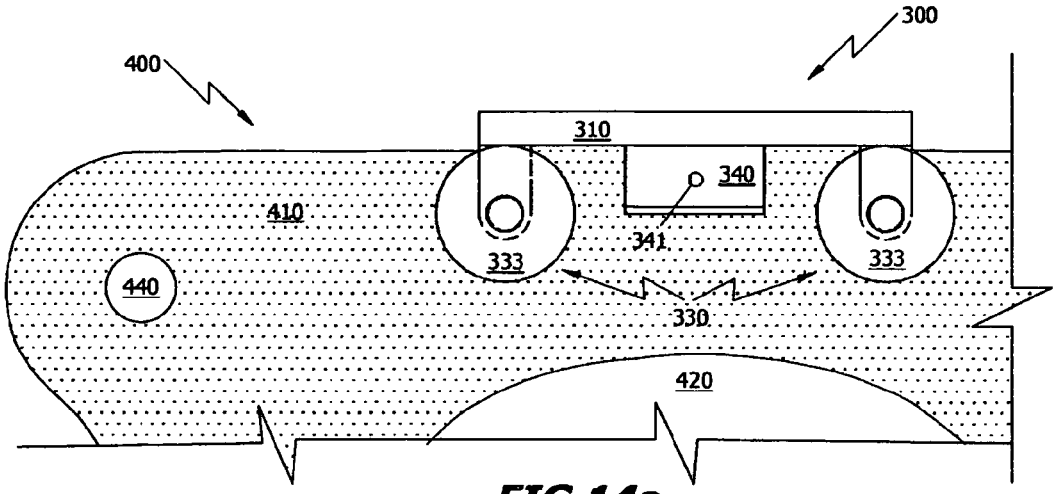
FIGS. 14*a, b* and *c* show top, front and side views of the docking sub-system engaged with the removable armrest platform, according to the present disclosure of the Toilet Armrest Support System.
Figure 14B:
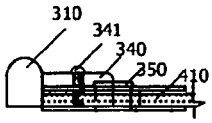
Figure 14C:
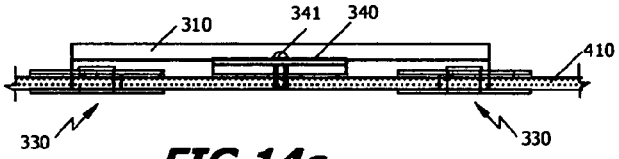

FIGS. 14*a*, 14*b* and 14*c* show top, side and front views, respectively, of armrest platform 410 engaged into docking subsystem 300. Docking ports 330 and anchor block 340 along with its locking mechanism 341 are also shown in the same figures. Opening 440 shown in FIG. 14*a* is one of the openings to which armrest 600 shown in FIG. 17 attaches. FIG. 14*a* also shows opening 420 over a toilet although a toilet rim is not shown here in order not to unnecessarily obscure the aspects of the present disclosure. It will be evident more readily from enlarged front and side views FIGS. 15*a* and 15*b*, respectively, that lower docking port discs 333' would be sitting on a toilet rim 25 underneath toilet seat 30 shown in FIG. 17, for example. Armrest platform 410 is removed from FIGS. 15*a* and 15*b* in order to show more clearly the elevated position of anchor block 340 by a nominal height 342 of at least ¼" ranging from about 8/32 to about 9/32 inches above the surface a standard toilet rim (not shown). Height 342 is equivalent to the space provided in docking ports 330 in between upper and lower docking discs 333 and 333', respectively, and the thickness of one of the discs, to receive the removable armrest platform 410 (not shown in FIGS. 15*a* and 15*b*).

In another embodiment of the presently disclosed Toilet Armrest Support System, a locking mechanism 341 provides a means for securing the armrest platform 410 once slid into position in the docking ports 330 disposed over a standard toilet rim. In FIG. 15*a*, locking mechanism 341 utilizes a threaded thumb screw 341' incorporated to anchor block 340 to fasten the armrest platform 410 to the anchor block. The thumb screw is screwed down into a corresponding threaded hole on the armrest platform which locks it in place. A cam actuator (not shown) may also be used to obviate the use of a screw-driver, for example.

Referring to the drawing in FIG. 16, in one embodiment, the armrest platform 410 approximates a contoured trapezoidal shape wherein the outer overall dimension 510 of the rear edge engaged in the docking sub-system 300 has a nominal width (including the circular sectors A at rear vertices of an imaginary trapezoid of the same dimensions) of 20 inches, while the outer dimension 505 of the frontal open edge opposite the rear edge, including the circular sectors A', has a nominal width of 24 inches. Curve B is a smooth curve that blends together the circular sectors A and A' (at lower vertices of the trapezoid) without exceeding a distance 507 from about 1⅞ to about 2⅛ inches as shown in FIG. 6. The length (or depth from front to rear) dimension 530 of the armrest platform 410 is uniform nominally at 12 inches ranging from about 11¾ to 12¼ inches to accommodate approximately half the length of the rim of a standard toilet system. (It will be noted that a trapezoid is commonly referred to as having bases and height, which correspond to the widths and length, respectively, used here). The removable armrest platform 410 of the present disclosure comprises 3/16-inch aluminum although it can be made out of any material suitable in a toilet environment. It will also be understood that armrest platform 410 can also be made to cover all of the oval-like rim area of a toilet system. In that aspect, armrest platform 410 can be made to fold symmetrically about its vertical axis 500 shown in FIG. 16 to aid in the packaging and transportation of the same. When installed, the oval-like armrest platform (not shown) can be locked flat by means of a latch in the frontal portion.

More specifically, in one aspect, the frontal portion of the armrest platform 410 has an opening conformal to the dimensions of the rim of a toilet system with a nominal dimension 550 of 11 inches ranging from about 10⅞ to about 11⅛ inches. The internal dimensions of the opening 420 of the armrest platform 410 shown in FIG. 16—commensurate with the dimensions of a standard toilet system (though it will be understood that these dimensions may be modified to fit the dimensions of other specialized toilet systems)—are R540 ranging from about 5¼ to 5¾ inches and R545 ranging from about 5⅝ to about 5¾ inches. Further, the frontal edge of armrest platform 410 has a nominal dimension 555 of 4½ inches ranging from about 4⅜ to about 4⅝ inches symmetrically on both sides of the vertical axis 500 as shown in FIG. 16. The overall dimension 505 of the frontal edge reaches a nominal width of 24 inches ranging from about 23¾ to about 24¼ inches with the inclusion of a nominally 2 inch radius circular arc A with an included 150° angle ranging from about 145° to about 155° as shown in FIG. 16. Similarly, the overall dimension 510 of the rear edge reaches a nominal width of 20 inches ranging from about 19¾ to about 21¼ inches with the inclusion of the same 2 inch radius circular arc A with an included 150° angle ranging from about 145° to about 155° as shown in the same FIG. 16. In still another aspect, circular openings 440 and 440' are formed at the center of arcs A and A'-symmetrically about the vertical axis 500 as shown in FIG. 16—with nominal radii of ½ inch ranging from about 7/16 to 9/16 inch. Openings 440 and 440' where the legs 620 of armrests 600 shown in FIG. 17 are to be inserted into armrest platform 410 are off-set by a nominal distance 507 of 2 inches ranging from about 1⅞ to about 2⅛ inches as shown in FIG. 16.

An embodiment of the present Toilet Armrest Support System provides different combinations of attaching different types of armrests to the removable armrest platform. In one aspect shown in FIG. 8, the rear leg 121 of armrest 130 attaches to the back top surface of the removable platform 120 and the front leg 122 loops around to the front and attaches to the underside of the platform 120. In another aspect in FIG. 9, both legs 121 and 122 attach to the top surface of the armrest platform 120. In yet another aspect shown in FIG. 17, both rear and front legs 621 and 622, respectively, attach to the bottom surface of the removable armrest platform 410.

It will be evident to those skilled in the art that the toilet armrest support system of FIG. 8 provides the largest open area under the armrest 130 for larger individuals requiring more space. The armrests 130 are nominally 24 inches apart in the front ranging from about 23¾ to 24¼ inches, matching the 24-inch dimension of the widest portion of the armrest platform 120. The slant height 132 of the armrest 130 in FIG. 8 is nominally 12½ inches ranging from about 12¼ to about 12¾ inches. The smaller armrest prototype shown in FIG. 9 provides a narrower profile with smaller handles 130 and shorter legs 121 and 122 to suit better smaller body sizes. The armrests 130 are nominally 19 inches apart ranging from about 18 to 20 inches in the front, and the height 132 of the armrests is nominally 10½ inches ranging from about 10¼ to 10¾ inches. The armrest support system 600 shown in FIG. 17 provide still other variations of armrests that may be incorporated into the presently disclosed Toilet Armrest Support System by varying the height 610 of the armrests and the geometry of legs 621 and 622.

Though these numerous details of the disclosed apparatus are set forth here, such as materials and dimensional parameters, to provide an understanding of the present invention, it will be obvious, however, to those skilled in the art that these specific details need not be employed to practice the present disclosure. It is to be noted that the dimensions shown in FIG. 16 are established based on the current industry standard toilets. For example, the 12 inch depth dimension 530 is based on a common dimension that can be used on both round and elongated toilets and may be modified to accommodate any future toilet systems. In addition, locking mechanism 341, consisting of a threaded thumb screw is incorporated into anchor block 340 shown in FIGS. 12 and 13. The thumb screw is screwed down into corresponding threaded opening 341' in the armrest platform 410 which locks it in place. It will be understood that other locking mechanisms, including snap bolts such as used on aircraft cowlings may also be utilized. The anchor block 340 provides the removability aspect of the armrest platform 410 by releasing the fastener from the armrest platform 410. Once the armrest platform (along with armrests 600 if not already detached from the armrest platform 410) is removed from anchor block 340, only the relatively small docking sub-system 300—to which the hidden anchor block 340 is attached—remains barely visible behind the toilet seat 30, as shown in FIG. 17. As described earlier, the docking sub-system 300 having docking piers 323 is disposed over the centrally disposed porcelain rim 25 with openings 320 (as shown in FIGS. 10 and 11) aligned with the existent toilet seat 30 hinge openings and fastened to the toilet with the toilet seat threaded screw fasteners 12 as seen in FIGS. 4 and 5. It will be evident to the skilled in the art that other devices, such as clamps, may also be used to secure the docking sub-system to the rim of a standard toilet system. In other aspects, although the armrest platform is described as being symmetrical about line 500 in FIG. 16, it need not be so. At the same time, it will be evident that the same parameters may be employed in other similar devices that are too many to cite, such as specialty toilet systems other than that of standard toilet systems.

While the disclosed invention has been particularly shown and described with reference to particular embodiments, it will be appreciated that variations of the above-disclosed embodiments and other features and functions, or alternatives thereof, may be desirably combined into many other different systems or applications For example, although the disclosed Toilet Armrest Support System has been described in relation to standard toilet systems, it will be understood that the system can be modified to fit other toilet systems. Also that various presently unforeseen and unanticipated alternatives, modifications, variations or improvements therein may be subsequently made by those skilled in the art which are also intended to be encompassed by the following claims.

What is claimed is:

1. An apparatus comprising a toilet armrest support system disposed over an existing toilet bowl having centrally disposed opening with a rim, the armrest support system further comprising at least one or more armrests supported by a removable armrest platform disposed underneath an existing toilet seat and engaged to a docking sub-system which in turn is fastened to existing hinge openings with toilet seat fasteners on the rear of a standard toilet system;

the docking sub-system having at least two or more docking ports to receive slideably slotted edge of the removable armrest platform and an anchor block having an elevated portion forming a cavity located centrally in between the docking ports;

the anchor block configured to receive the slotted edge of the removable armrest platform slideably in the cavity and to lock/unlock the armrest platform in situ with the turn of a latching mechanism by hand; and wherein the removable platform is formed to fit over the toilet rim and provide a wider sitting area towards a front portion of the toilet seat than towards the rear to readily accommodate the entry of differing body sizes onto the toilet seat with armrest support.

2. The apparatus according to claim 1, wherein the removable armrest platform comprises aluminum plate of a contoured trapezoidal shape with a thickness from about 5/32 inches to about 7/32 inches.

3. The apparatus according to claim 2, wherein the contoured trapezoidal shape has a frontal width ranging from about 23¾ to about 24¼ inches, rear width from about 19¾ to about 20¼ inches, and a depth from about 11¾ to about 12¼ inches.

4. The apparatus according to claim 2, wherein the contoured trapezoidal shape comprises vertices formed into blending circular arcs having radii from about 1⅞ inches to about 2⅛ inch.

5. The apparatus according to claim 1, wherein the docking sub-system comprises a docking bar having at least a first end and a second end, each end having a docking pier, and corresponding to each docking pier, a docking port, the docking ports having docking plates configured spatially apart to receive the removable armrest platform slideably in between the docking plates.

6. The apparatus according to claim 5, wherein the docking bar comprises at least one anchor block disposed between the docking piers at each end, the anchor block configured to secure and release the removable platform.

7. The apparatus according to claim 5, wherein the docking bar has a length from about 6 to about 6½ inches, width from about ⅜ to about ⅝ inches and a height from about ⅝ to about ¾ inches.

8. The apparatus according to claim 5, wherein the anchor block is formed at a height from about 8/32 to about 9/32 inches above the surface of the toilet rim to receive the slideable armrest platform underneath.

9. The apparatus according to claim 5, wherein the docking pier has a length from about 1¼ to about 1½ inches, width from about 3/16 to about 5/16 inches and a thickness from about 3/16 to about 4/16 inches.

10. The apparatus according to claim 5, wherein the docking plates comprise one or more 2-inch diameter steel washers having a thickness of about 1/16 inch disposed above and below the docking pier.

11. An apparatus comprising a toilet armrest support system, the armrest support system further comprising at least one or more armrests supported by a removable armrest platform disposed underneath an existing toilet seat and slideably engaged to an anchor block of a docking sub-system, which in turn is fastened to existing hinge openings with toilet seat fasteners on the rear of a standard toilet system;

wherein the docking sub-system comprises a docking bar having at least a first end and a second end, each end having a docking pier and corresponding to each docking pier, a docking port;

the docking port comprising a pair of docking plates configured spatially apart to form a receptacle to receive slideably a slotted edge of the removable armrest platform; and at least one anchor block disposed between the docking pier at each end, the docking ports being configured to receive slideably the slotted edge of the removable armrest platform, the anchor block being elevated to slideably receive below it the slotted edges of the armrest platform to secure/release the removable platform from the existing toilet.

12. The apparatus according to claim 11, wherein the docking bar has a length from about 6 to about 6½ inches, width from about ⅜ to about ⅝ inches and a height from about ⅝ to about ¾ inches.

13. The apparatus according to claim 5, wherein the anchor block is formed at a height from about 8/32 to about 9/32 inches above the surface of the toilet rim to receive the slideable armrest platform underneath.

14. The apparatus according to claim 11, wherein the removable platform comprises a contoured trapezoidal 3/16 inch aluminum flat plate having a frontal side width ranging from about 23¾ to about 24¼ inches, rear side width from about 19¾ to about 20¼ inches, and a depth from about 11¾ to about 12¼ inches.

15. The apparatus according to claim 11, wherein rear armrest legs of the armrest attach to a rear top portion of the removable platform while front legs of the armrest loop around to the front side and attach to an underside portion of the platform supporting the armrests.

16. The apparatus according to claim 11, wherein rear armrest legs of the armrest attach to a rear top portion of the removable platform while front legs of the armrest loop around to the front side and attach to an upper side portion of the platform supporting the armrests.

17. The apparatus according to claim 11, wherein the armrests have a height ranging from about 10¼ to about 10¾ inches over the removable platform and are apart from about 18 to 20 inches frontally.

18. The apparatus according to claim 11, wherein rear armrest legs of the armrest attach to a rear underside portion of the removable platform and the front legs of the armrest loop around to the front side and attach to an underside portion of the platform supporting the armrests.

19. The apparatus according to claim 11, wherein the armrests have a height ranging from about 12¼ to about 12¾ inches over the removable platform and are apart from about 23¾ to 24¼ inches frontally.

20. An apparatus comprising a toilet armrest support system further comprising a removable armrest platform dockable to a docking sub-system, the removable armrest platform having one or more removable armrests;

the docking sub-system of unitary construction further comprising a docking bar having at least a first end and a second end, each end having a docking pier and corresponding to each docking pier, a docking port;

the docking port comprising at least two or more docking plates configured spatially apart to receive slideably one or more slots provided on the armrest platform;

at least one anchor block disposed substantially centrally in between the docking piers;

the anchor block elevated to slideably receive underneath and lock in place the removable armrest platform substantially centrally with a latching mechanism provided in the anchor block;

the latching mechanism capable of locking and unlocking the armrest platform in situ with the turn of a latching mechanism by hand; and thus providing a toilet armrest platform that can be slid in and out from the docking sub-system for comfort and sanitary care.

* * * * *